United States Patent [19]

Tsuchihashi et al.

[11] Patent Number: 4,469,986

[45] Date of Patent: Sep. 4, 1984

[54] LOW PRESSURE DISCHARGE LAMP WITH POLYGON SHAPED ENVELOPE

[75] Inventors: Michihiro Tsuchihashi; Yoshinori Anzai; Toshiro Kajiwara; Takeo Saikatsu, all of Kamakura, Japan

[73] Assignee: Mitsubishi Denki Kabushiki Kaisha, Tokyo, Japan

[21] Appl. No.: 315,929

[22] Filed: Oct. 28, 1981

[30] Foreign Application Priority Data

| | | | |
|---|---|---|---|
| Feb. 5, 1981 | [JP] | Japan | 56-15958 |
| Feb. 24, 1981 | [JP] | Japan | 56-25699 |
| Feb. 24, 1981 | [JP] | Japan | 56-25700 |
| Feb. 24, 1981 | [JP] | Japan | 56-25701 |
| Feb. 24, 1981 | [JP] | Japan | 56-25702 |
| Mar. 20, 1981 | [JP] | Japan | 56-40707 |

[51] Int. Cl.[3] ..... H01J 61/02; H01J 61/30

[52] U.S. Cl. ..... 313/610; 313/634

[58] Field of Search ..... 313/609, 610, 611, 612, 313/613, 634, 491, 485, 493, 573; D26/3

[56] References Cited

U.S. PATENT DOCUMENTS

| | | | |
|---|---|---|---|
| 2,213,245 | 9/1940 | Germer | 313/493 |
| 4,182,975 | 1/1980 | Young | 313/485 |
| 4,184,101 | 1/1980 | Young | 313/485 |
| 4,191,907 | 4/1980 | Rogoff | 313/485 X |
| 4,281,271 | 7/1981 | Young et al. | 313/610 X |

*Primary Examiner*—Palmer C. Demeo
*Assistant Examiner*—Sandra L. O'Shea
*Attorney, Agent, or Firm*—Oblon, Fisher, Spivak, McClelland & Maier

[57] ABSTRACT

A low pressure discharge lamp has a nonlinear arc path formed by a partition in a lamp envelope wherein the lamp envelope is polyhedral and the partition is fixed to the corners of said polyhedron lamp envelope.

21 Claims, 18 Drawing Figures

LOW PRESSURE DISCHARGE LAMP WITH POLYGON SHAPED ENVELOPE

BACKGROUND OF THE INVENTION

1. Field of the Invention

The present invention relates to an improved low pressure discharge lamp having a nonlinear arc path formed by a partition placed in the lamp envelope.

2. Description of the Prior Art

Various attempts have been made to improve lighting fixtures because of strong demand of saving energy. Incandescent lamps have also been a target for the improvement. For example, a high efficient fluorescent lamp is miniaturized and is substituted for a low efficient incandescent lamp.

An approach for miniaturizing the fluorescent lamp is to form a series of multi-bent path by a partition (6) in a cylindrical lamp envelope (2) to provide the longest arc path in a limited space in the lamp envelope.

Use of the partition (6) provides effectively a long arc path in the limited space and is one of the most desirable ways for fabricating a small sized fluorescent lamp instead of the incandescent lamp.

In the conventional fluorescent lamp having a partition, a circular glass envelope or a spherical glass envelope has been used as a lamp envelope (2). It is necessary to employ a hermetically sealing or a special method for fixing the partition made of glass or metal plate. This causes the following disadvantages: it takes much time for fabricating the lamp; the sealed portion is visible from the outside because application of phosphor on the sealed portion is impossible; when the phosphor peels off from the connecting part of the partition (6) in the lamp envelope (2), a transparent portion appears in the lamp; and the resulting phosphorlost part becomes large due to the vibration during transportation.

SUMMARY OF THE INVENTION

It is an object of the present invention to provide a partition type low pressure discharge lamp having a polyhedral lamp envelope, thereby easily fitting a partition and easily fabricating the lamp.

It is another object of the present invention to provide a low pressure discharge lamp without causing the peeling-off of phosphor from the hermetically sealed portion of the partition which has been found in the conventional lamp, thereby providing an excellent appearance.

It is still another object of the present invention to provide a partition type low pressure discharge lamp in which the shape of a lamp envelope is polyhedral rather than cylindrical or spherical as in the conventional lamp envelope and a partition for forming a nonlinear path is inserted into the lamp envelope to fit it whereby problem of the tolerance between the lamp envelope and the partition is eliminated, thus the partition is easily fitted on the lamp envelope and mass production can be attained.

The foregoing and other objects of the present invention have been attained by providing a low pressure discharge lamp having a nonlinear arc path formed by a partition in a lamp envelope and electrodes at both ends of the arc path wherein the lamp envelope is polyhedral and the partition is fitted on a part of the corner of the polyhedral lamp envelope.

In the structure of the lamp of the present invention, the contacting portion of the partition is formed so as to correspond to the shape of the corner of the lamp envelope whereby the fixing of the partition is easily performed.

In the structure of the lamp of the present invention, the contacting portion of the partition is bent to allow the fixing of the bent portion at the corner of the lamp envelope, thus the partition can be easily and certainly fixed.

In the structure of the lamp of the present invention, a recess is formed at the corner of the lamp envelope so as to fix the partition.

BRIEF DESCRIPTION OF THE DRAWINGS

The same reference numerals designate the same or corresponding parts throughout several views.

DETAILED DESCRIPTION OF THE PREFERRED EMBODIMENTS

Several preferred embodiments of the present invention will be described.

Figure 1:
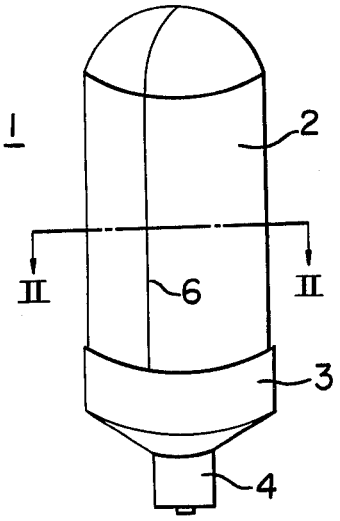
FIG. 1 PRIOR ART
FIG. 1 is a front view of the conventional partition type fluorescent lamp as a low pressure discharge lamp.
Figure 2:
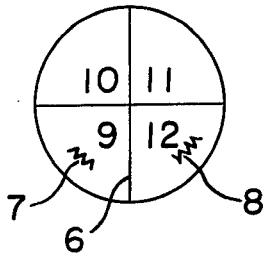
FIG. 2 PRIOR ART
FIG. 2 is a schematic sectional view taken along II—II line of FIG. 1.
Figure 3:
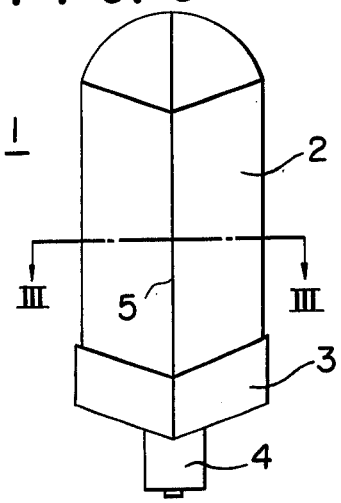
FIG. 3 is a front view of an embodiment of the partition type fluorescent lamp of the present invention.
Figure 4:
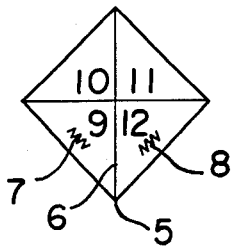
FIG. 4 is a schematic sectional view of III—III line of FIG. 3.

FIG. 3 is a front view of an embodiment of the partition type fluorescent lamp as a low pressure discharge lamp and FIG. 4 is a sectional view taken along III—III line of FIG. 3. In the figures, the reference numeral (1) designates a lamp; (2) designates a polyhedral lamp envelope made of glass; (3) designates a holder, made of synthetic resin, for holding a lamp operating unit; (4) designates an E26 base applicable to an incandescent lamp; (5) designates corner of the polyhedral lamp envelope; (6) designates a partition made of metal plate which is fixed in the lamp envelope; (7), (8) designate electrodes and (9), (10), (11), and (12) respectively designate arc paths separated by the partition.

The partition is fixed by fitting in the corner (5) of the lamp envelope (2) to divide the space inside the lamp envelope (2) so as to form an arc path having a predetermined length.

A pair of thermionic electrodes (7), (8), are separated by the partition (6) and located on the side of the lamp operating unit of the lamp envelope (2). Phosphor is applied on the inner surface of the lamp envelope (2). A desired amount of mercury and a rare gas such as argon are also enclosed in the lamp envelope. A lamp operating unit for operating on the lamp is held in the holder (3) for holding the unit.

In the partition type fluorescent lamp having the structure described above, when the lamp is fitted into a socket as the conventional incandescent lamp has been done, the lamp is actuated by the lamp operating unit held in the holder (3) to pass discharge current. The discharge current passes from the electrode (7) positioned by the lamp operating unit at the one end of the arc path (9) through the top of the lamp to the arc path (10). The discharge current further passes along the following path: the lamp operating unit area of the arc path (10)—the arc path (11)—the top of the lamp envelope the arc path (12)—the electrode (8) positioned in the lamp operating unit area of the lamp envelope. Thus, the discharge current passes through a nonlinear path to produce electric discharge between the electrodes (7), (8). The phosphor layer applied on the inner wall of the lamp envelope is activated by ultraviolet ray produced by the electric discharge to emit visible light from the lamp. The visible light is varied depending upon the kind of phosphor.

In the embodiment described above, a rectangular glass bulb is used as a lamp envelope; however, a polyhedral lamp envelope can be used. A rectangular or a hexadecagonal lamp envelope is preferably used in order to fix the partition. A triangular lamp envelope has disadvantages in that it is necessary to locate the electrodes at both end which causes difficulty in fabricating a lamp having a base at its one side as with the conventional incandescent lamp and also a lamp envelope having corners larger than heptadecagon has disadvantages in that the angle of the corner (5) is so large as to fix the partition and a phosphor layer is easily peeled off due to vibration during transportation.

In this embodiment, the arc path is formed so that electric discharge occurs along an up-down path formed by the partition; however the arc path can be formed by another way.

In the embodiment, the surface of the lamp envelope is flat or linear. It is possible to use a lamp envelope in which the surface is curved so as to have a radius larger than a corner to corner distance (linear distance).

Furthermore, in this embodiment, the lamp has a domed top. The domed top is not critical and a flat or uneven top can be used.

As described above, in accordance with the embodiment of a small-sized low pressure discharge lamp having a nonlinear arc path formed by a partition, a polyhedral lamp envelope is used instead of the conventional cylindrical or spherical lamp envelope and the partition is fixed at the corner of the lamp envelope whereby the lamp can be easily fabricated and the peeling-off of the phosphor layer can be prevented. In the modification of the embodiment, the contacting portion of the partition is formed so as to correspond to the shape of the corner of the lamp envelope. Accordingly, even though the phosphor layer coated on the contacting portion is peeled off, the appearance of the lamp envelope is better than that of the conventional cylindrical or spherical lamp envelope.

Figure 5:
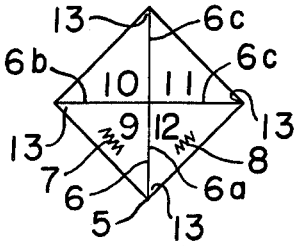
FIG. 5 is a schematic sectional view of another embodiment of the lamp of the present invention.
Figure 6:
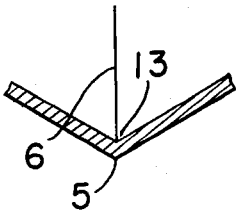
FIG. 6 is an enlarged sectional view, partly omitted, of the lamp shown in FIG. 5.

FIGS. 5 and 6 show another embodiment of the low pressure discharge lamp of the present invention. In the figures, the reference numeral (13) designates respectively the bent portion of the partition (6) which has four partition plates (6*a*) to (6*d*) fixed in the lamp envelope, the bent portion of each plate being bent from the point contacting with the corner toward the inner wall of the lamp envelope. The discharge lamp is fabricated by inserting a partition (6) so that each end of four plates is brought into contact with each corner (5) of the lamp envelope (2). In this case, the end portion of the plate will have a linear contacting portion against the corner (5) because a bent portion (13) is formed at the end of the partition plate.

The shape of the bent portion of the partition plate is not necessarily to be in J-like shape as shown in FIG. 5 but can be in b or V-like shape as long as the bent portion is fitted on the inner wall of the corner (5) of the lamp envelope (2).

In the embodiment, a partition (6) having four plates is used. It is, however, possible to use two partition plates with notched portion at the center, the partition plates being assembled in a crossing state. The partition plates can be either flat i.e. linear plate or curved (zigzagged) plate which has a length greater than the distance between the crossing point of the partition plates and the corner (5).

In accordance with the embodiment, a lamp envelope having a polyhedral configuration is used instead of a cylindrical or spherical shape as found in the conventional lamp envelope and a partition having bent portions is fixed to the corner of the lamp envelope whereby the lamp can be easily fabricated, the partition can be kept by the line-contact of the bent portions with the corners of the lamp envelope and the phosphor layer is prevented from peeling-off from the inner surface of the lamp envelope.

Figure 7:
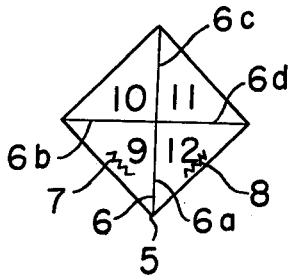
FIG. 7 is a schematic sectional view of still another embodiment of the lamp of the present invention.
Figure 8:
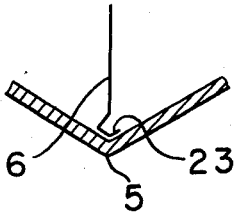
FIG. 8 is an enlarged sectional view, partly omitted, of the lamp shown in FIG. 7.

FIGS. 7 and 8 show another embodiment of the present invention. The partition (6) has four metallic partition-plates, assembled in crossing state, for separating the inside of the lamp envelope (2) into four chambers (9), (10), (11), (12) and each partition plate has an end portion bent so as to fit to the angled inner wall of the lamp envelope (2). The first partition plate (6*a*) has the lower end in close-contact with the covering surface of the lamp operating unit holder (3) and the upper end in close-contact with the inner wall of the lamp envelope (2); the second (6*b*) and the fourth partition plate (6*d*) respectively have the lower ends in close-contact with the covering surface of the lamp operating unit holder (3) and the upper ends extending to the inner wall of the lamp envelope with a gap; and the third partition plate (6*c*) has the lower end extending the covering surface of the lamp operating unit holder (3) with a gap and the upper end in close-contact with the inner wall of the lamp envelope (2).

In the embodiment, the end portions of the partition are so formed that the end portions establish a surface contact to the corners of the lamp envelope whereby the lamp can be easily fabricated; the fixing of the partition to the lamp envelope can be attained by the surface contact; and the peeling-off of the phosphor layer can be prevented.

Figure 9:
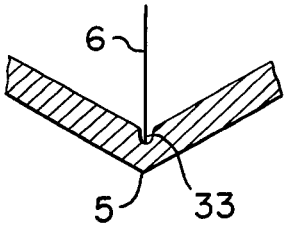
FIG. 9 is an enlarged sectional view, partly omitted, of a separate embodiment of the partition type fluorescent lamp of the present invention.

FIG. 9 shows another embodiment of the present invention. In the figure, the lamp envelope comprises four corners (5), (only one corner is shown), each corner being provided with a longitudinal slim groove (33)

in which an end of the partition (6) is inserted so as to hold the partition at four points.

The shape of the groove formed at the corner as shown in FIG. 5 is not critical but can be U or V shaped. The depth of the groove can be selected depending upon the size or shape of the partition (6).

In accordance with the embodiment, the lamp envelope having a plurality of corners, each corner being provided with a longitudinal groove, is used instead of the conventional cylindrical or spherical lamp envelope and the ends of the partition are inserted to the respective groove formed at the corner of the lamp envelope whereby the lamp can be easily fabricated and the partition can be certainly held by the grooves.

Figure 10:
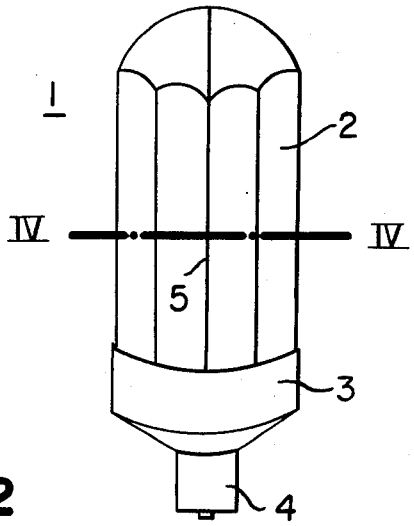
FIG. 10 is a front view of another embodiment of the lamp of the present invention.
Figure 11:
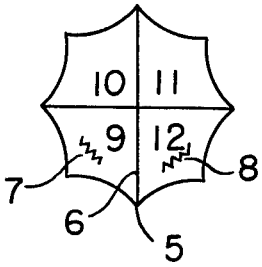
FIG. 11 is a schematic sectional view taken along IV—IV line of FIG. 10.
Figure 12:
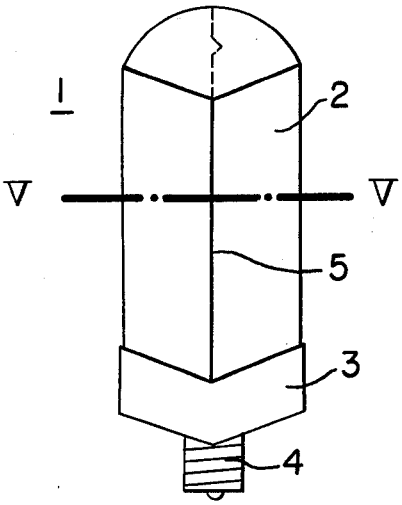
FIG. 12 is a front view of another embodiment of the lamp.

FIGS. 10 and 11 show another embodiment of the present invention wherein the reference numeral (2) designates a lamp envelope tube having an octagonal cross section, made of glass, and having a domed top and 8 side-surfaces inwardly curved; (5) designates corner of the lamp envelope (2); (6) designates a metallic partition which is placed in the lamp envelope so as to form an arc path in lamp envelope, said partition being fixed by making it in close-contact with the corners.

In the embodiment octagonal lamp envelope is used. However, it is not critical but can be polyhedral lamp envelope. It is preferable to use a polyhedral lamp envelope having 4 to 32 corners for the purpose of fixing the partition. A triangular lamp envelope has disadvantages in that it is necessary to locate electrodes at the top and the lamp operating unit holder side respectively, thus causing difficulty in fabricating a lamp with one end having a base as found in the conventional incandescent lamp. In a polyhedral lamp envelope having more than 32 corners, the angle of the corner is too large to fix the partition effectively and phosphor layer is easily peeled off due to the vibration during transportation.

In accordance with the embodiment, a polyhedral lamp envelope with side surfaces inwardly curved is used instead of the conventional cylindrical or spherical lamp envelope and the partition is fixed by the corners of the lamp envelope whereby the lamp can be easily fabricated and the peeling-off of the phosphor layer can be prevented.

Figure 13:
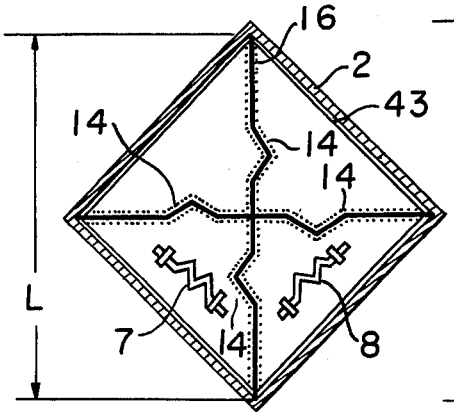
FIG. 13 is a sectional view taken along V—V line of FIG. 12.
Figure 14:
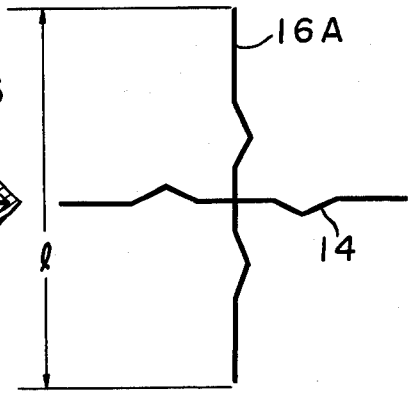
FIG. 14 is a sectional view of the partition.

FIGS. 12 to 15 show another embodiment of the present invention. In the figures, a partition (16), made of metal, has four partition plates crossing each other, each partition plate having a middle bent portion. The partition (16) is fixed in the lamp envelope (2) by fitting the end of the plate into each corner (5) of the lamp envelope thereby forming an arc path in the lamp envelope. FIG. 14 shows the partition (16A) in free condition, i.e., a condition before inserting into the lamp envelope and the span (l) of the partition (16A) is slightly larger than the inner span (L) of the lamp envelope (2) as shown in FIG. 13. Insertion of the partition into the lamp envelope can be easily performed by further bending the bent portion of the partition (16A). When the partition has been fitted into the lamp envelope (2), an excellent securing can be obtained by the spring action of the bent portion (14) formed in the partition (16). The partition provides a stability against vibration and heat expansion and no short-circuit discharge occurs.

A pair of electrodes (7), (8) are positioned in the lamp operating unit holder side opposing each other in relation to the partition (16) and a phosphor layer (43) is applied on the inner wall of the lamp envelope (2).

Figure 15:
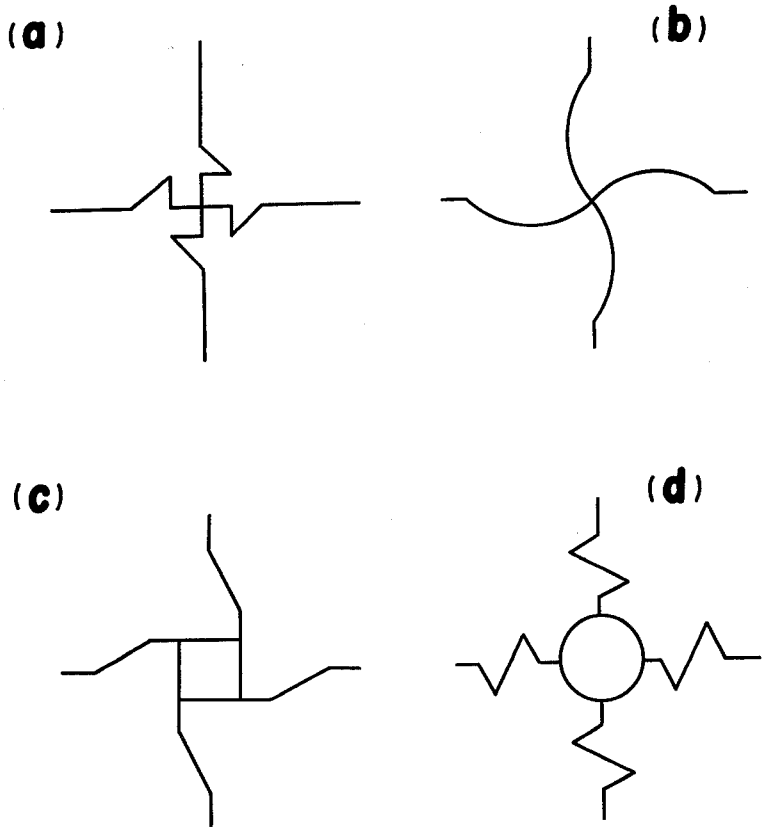
FIG. 15 is schematic views showing modification of the partitions.

FIGS. 15 (*a*) to (*d*) shows several modifications of the partition. These are the way of examples and various nonlinear shape can be considered.

In accordance with the embodiments having a nonlinear partition, problems of dimensional tolerance between the lamp envelope and the partition and occurrence of short-circuiting because of insufficient contact of the partition with the lamp envelope can be eliminated and the productivity can be increased.

We claim:

1. A low pressure discharge lamp comprising:
   (a) a lamp envelope the cross-sectional shape of which perpendicular to the axis of the lamp is in the shape of a polygon every vertex angle of which opens towards the axis of the lamp and
   (b) a partition disposed in said lamp envelope so as to form a non-linear arc path, said partition being fixed to said lamp envelope at at least one vertex thereof.

2. A low pressure discharge lamp according to claim 1 wherein the portion of said partition which is fixed to said lamp envelope is bent backwards from the point contacting said at least one vertex such that said portion makes linear contact with said lamp envelope.

3. A low pressure discharge lamp according to claim 1 wherein the portion of said partition which is fixed to said lamp envelope is bent so as to make a surface-to-surface contact with the inner surface of said lamp envelope.

4. A low pressure discharge lamp according to claim 1 wherein:
   (a) a groove is formed in said lamp envelope at said at least one vertex and
   (b) a side of said partition is inserted into said groove.

5. A low pressure discharge lamp according to claim 1 wherein said polygon has between four and sixteen vertices.

6. The low pressure discharge lamp according to claim 1 wherein between each vertex is a surface of the lamp envelope which is planar.

7. The low pressure discharge lamp according to claim 1 wherein between each vertex is a surface of the lamp envelope which is non-planar, whereby the corner-to-corner distance along the side surfaces is greater than the linear corner-to-corner distance.

8. The low pressure discharge lamp according to claim 7 wherein between each vertex is a surface of the lamp envelope which is curved.

9. The low pressure discharge lamp according to claim 8 wherein between each vertex is a surface of the lamp envelope which is outwardly concave.

10. A low pressure discharge lamp according to claim 9 wherein said polygon has between 4 and 32 vertices.

11. The low pressure discharge lamp according to claim 1 wherein said partition is comprised of a plurality of non-planar partition plates radially disposed in said lamp envelope.

12. The low pressure discharge lamp according to claim 11 wherein said plurality of non-planar partition plates radiate from a central linear axis.

13. The low pressure discharge lamp according to claim 11 wherein said plurality of non-planar partition plates radiate from a central core of finite cross-section.

14. The low pressure discharge lamp according to claim 11 wherein between each vertex is a surface of the lamp envelope which is planar.

15. The low pressure discharge lamp according to claim 11 wherein between each vertex is a surface of the lamp envelope which is non-planar, whereby the corner-to-corner distance along the side surfaces is greater than the linear corner-to-corner distance.

16. The low pressure discharge lamp according to claim 15 wherein between each vertex is a surface of the lamp envelope which is curved.

17. The low pressure discharge lamp according to claim 16 wherein between each vertex is a surface of the lamp envelope which is outwardly concave.

18. The low pressure discharge lamp according to claim 11 wherein:

(a) said plurality of non-planar partition plates are made of resilient material and (b) the span of said plurality of non-planar partition plates perpendicular to the axis of said lamp envelope is greater before insertion into said lamp envelope than it is after insertion into said lamp envelope, whereby said partition is held in said lamp envelope by spring action.

19. A low pressure discharge lamp comprising:

(a) a lamp envelope the cross-sectional shape of which perpendicular to the axis of the lamp is in the shape of a polygon, said lamp envelope having a groove formed therein at at least one vertex thereof, and (b) a partition disposed in said lamp envelope so as to form an non-linear arc path, one side of said partition being inserted into said groove and said partition being fixed to said lamp envelope at said at least one vertex thereof.

20. A low pressure discharge lamp comprising:

(a) lamp envelope the cross-sectional shape of which perpendicular to the axis of the lamp is in the shape of a polygon at least some of the sides of which are outwardly concave and (b) a partition disposed in said lamp envelope so as to form a non-linear arc path, said partition being fixed to said lamp envelope at at least one vertex thereof.

21. A low pressure discharge lamp according to claim 20 wherein all of the sides of said polygon are outwardly concave.

* * * * *